US009589503B2

(12) United States Patent
Kong et al.

(10) Patent No.: US 9,589,503 B2
(45) **Date of Patent: *Mar. 7, 2017**

(54) ORGANIC LIGHT-EMITTING DISPLAY APPARATUS

(71) Applicant: SAMSUNG DISPLAY CO., LTD., Yongin, Gyeonggi-Do (KR)

(72) Inventors: Ji-Hye Kong, Yongin (KR); Sung-Jae Moon, Yongin (KR); Wang-Jo Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 124 days.

This patent is subject to a terminal disclaimer.

(21) Appl. No.: 14/332,568

(22) Filed: Jul. 16, 2014

(65) Prior Publication Data

US 2015/0248861 A1 Sep. 3, 2015

(30) Foreign Application Priority Data

Feb. 28, 2014 (KR) ..... 10-2014-0023798

(51) Int. Cl.
*G09G 3/3266* (2016.01)
*G09G 3/32* (2016.01)
*G09G 3/00* (2006.01)

(52) U.S. Cl.
CPC ..... *G09G 3/3233* (2013.01); *G09G 3/006* (2013.01); *G09G 2300/0413* (2013.01);
(Continued)

(58) Field of Classification Search
CPC .. G09G 3/2007; G09G 3/3266; G09G 3/3291; G09G 3/3258
See application file for complete search history.

(56) References Cited

U.S. PATENT DOCUMENTS

2003/0111964 A1 6/2003 Childs
2006/0061524 A1* 3/2006 Suh ..... G09G 3/3216 345/76

(Continued)

FOREIGN PATENT DOCUMENTS

KR 10-2004-0075005 8/2004
KR 10-2008-0024009 3/2008

(Continued)

OTHER PUBLICATIONS

U.S. Office action dated Aug. 19, 2015, for cross reference U.S. Appl. No. 14/259,098, (13 pages).

*Primary Examiner* — Ricardo L Osorio
(74) *Attorney, Agent, or Firm* — Lewis Roca Rothgerber Christie LLP

(57) ABSTRACT

An organic light-emitting display apparatus includes: a power voltage generation unit configured to generate a first power voltage and a dummy power voltage having a different level from that of the first power voltage; a power voltage wiring network to which the first power voltage is applied; a dummy power voltage line to which the dummy power voltage is applied; a plurality of pixels each comprising an emission device and a pixel circuit electrically coupled to the power voltage wiring network; a plurality of dummy pixels each comprising a dummy circuit connectable to the dummy power voltage line; and a plurality of repair lines each connectable to the dummy circuit of a corresponding dummy pixel among the plurality of dummy pixels and to the emission devices of corresponding pixels among the plurality of pixels.

16 Claims, 7 Drawing Sheets

(52) U.S. Cl.
CPC . *G09G 2320/0223* (2013.01); *G09G 2330/02* (2013.01); *G09G 2330/08* (2013.01); *G09G 2330/10* (2013.01)

(56) References Cited

U.S. PATENT DOCUMENTS

2006/0149493 A1 7/2006 Sambandan et al.
2007/0115235 A1* 5/2007 Park ..... G09G 3/3611 345/93
2008/0238327 A1 10/2008 Cho et al.
2011/0069061 A1 3/2011 Nakamura
2011/0080173 A1 4/2011 Kim et al.
2012/0104393 A1* 5/2012 Cho ..... H01L 27/1255 257/59
2012/0146990 A1 6/2012 Kim
2013/0176194 A1 7/2013 Jin et al.
2014/0347401 A1* 11/2014 Hwang ..... G09G 3/3233 345/690
2015/0022513 A1* 1/2015 Kim ..... G09G 3/22 345/212
2015/0062471 A1* 3/2015 Sung ..... G09G 3/3655 349/33
2015/0109189 A1* 4/2015 Hwang ..... G09G 3/3225 345/78
2015/0123884 A1* 5/2015 Kim ..... G09G 3/006 345/77
2015/0130787 A1* 5/2015 Chung ..... G09G 3/3225 345/214
2015/0138171 A1* 5/2015 Kim ..... H01L 27/3223 345/205
2015/0161931 A1* 6/2015 Lee ..... G09G 3/2007 345/77
2015/0170562 A1* 6/2015 In ..... G09G 3/3258 345/80

FOREIGN PATENT DOCUMENTS

KR 10-2008-0100533 11/2008
KR 10-2010-0070857 6/2010
KR 10-2010-0079095 7/2010
KR 10-2012-0065138 6/2012
KR 10-2015-0052666 5/2015
KR 10-2015-0066959 6/2015

* cited by examiner

ORGANIC LIGHT-EMITTING DISPLAY APPARATUS

CROSS-REFERENCE TO RELATED APPLICATION

This application claims priority to and the benefit of Korean Patent Application No. 10-2014-0023798, filed on Feb. 28, 2014, in the Korean Intellectual Property Office, the disclosure of which is incorporated herein in its entirety by reference.

BACKGROUND

1. Field

One or more embodiments of the present invention relate to an organic light-emitting display apparatus.

2. Description of the Related Art

When a pixel is defective in a display device, the pixel may always emit light or never emit light, regardless of scan signals and data signals. Defective pixels that always emits light or never emit light may be identified or perceived by a viewer as a bright spots or a dark spots, respectively. In particular, bright spots may be highly visible, and thus bright spots may be relatively easily identified by viewers of display devices. The defective pixel may be repaired by using (or utilizing) a dummy pixel.

Although power voltages having the same level may need to be input into all pixels included in a panel in order to display a high quality image, levels of the power voltages input into the pixels may be different from each other depending on positions of the pixels due to a voltage IR drop caused by a current flowing through a power voltage line. When a position of a defective pixel repaired by using (or utilizing) a dummy circuit and a position of the dummy circuit are far away from each other, the levels of input power voltages may vary widely. Accordingly, the repaired pixel may emit brighter or darker light than that emitted by other pixels around the repaired pixel.

SUMMARY

Aspects of embodiments of the present invention are directed toward an organic light-emitting display apparatus capable of repairing a defective pixel by using or utilizing a dummy circuit.

Aspects of embodiments of the present invention are directed toward an organic light-emitting display apparatus configured to facilitate repairing defective pixels while reducing perceptible variations in brightness between pixels repaired by using (or utilizing) a dummy circuit due to a voltage IR drop of a power voltage line from pixels around the repaired pixels.

Additional aspects will be set forth in part in the description which follows and, in part, will be apparent from the description, or may be learned by practice of the presented embodiments.

According to one or more embodiments of the present invention, an organic light-emitting display apparatus includes: a power voltage generation unit configured to generate a first power voltage and a dummy power voltage having a different level from that of the first power voltage; a power voltage wiring network to which the first power voltage is applied; a dummy power voltage line to which the dummy power voltage is applied; a plurality of pixels each including an emission device and a pixel circuit electrically coupled to the power voltage wiring network; a plurality of dummy pixels each including a dummy circuit connectable to the dummy power voltage line; and a plurality of repair lines each connectable to the dummy circuit of a corresponding dummy pixel among the plurality of dummy pixels and to the emission devices of corresponding pixels among the plurality of pixels.

The power voltage generation unit may be configured to generate the dummy power voltage having a time-variant level.

The organic light-emitting display apparatus may further include: a control unit configured to receive image data and to control the plurality of pixels to display an image corresponding to the image data, wherein the control unit is configured to determine a level of the dummy power voltage based on at least a part of the image data, and to control the power voltage generation unit to generate the dummy power voltage having the determined level.

The control unit may be configured to determine the level of the dummy power voltage for each frame, and the level of the dummy power voltage may vary for each frame.

When the plurality of pixels include a first pixel having a defective pixel circuit, the emission device of the first pixel may be electrically separated from the defective pixel circuit of the first pixel, and may be electrically coupled to a corresponding first dummy pixel among the plurality of dummy pixels via a corresponding first repair line among the plurality of repair lines, and the dummy circuit of the first dummy pixel may be electrically coupled to the dummy power voltage line.

A first pixel power voltage having a lower level than that of the first power voltage may be input to the defective pixel circuit of the first pixel due to a voltage IR drop of the power voltage wiring network, and the power voltage generation unit may be configured to generate the dummy power voltage of a same level as that of the first pixel power voltage, and to provide the dummy power voltage to the dummy circuit of the first dummy pixel.

The organic light-emitting display apparatus may further include: a control unit configured to determine a level of the dummy power voltage and to control the power voltage generation unit to generate the dummy power voltage having the determined level.

The control unit may be configured to determine the level of the dummy power voltage based at least partially on a position of the first pixel.

The power voltage wiring network may include a power voltage wiring to which the first power voltage is applied, and a power voltage line for electrically coupling the power voltage wiring and the first pixel, and the plurality of pixels may include second pixels electrically coupled to the power voltage line to which the second pixels and the first pixel are commonly coupled, and the control unit may be configured to determine the level of the dummy power voltage based on values of image data corresponding to the second pixels.

The lower the level of the dummy power voltage, the values of the image data may have greater levels.

The control unit may be configured to determine a size of a voltage IR drop between a first part of the power voltage line coupled to the power voltage wiring and a second part of the power voltage line coupled to the first pixel based on the values of the image data, and to determine the level of the dummy power voltage to be lower than a level of the first power voltage as much as the determined size of the voltage IR drop.

The dummy circuit may be connectable to the power voltage wiring network.

A pixel power voltage having a lower level than that of the first power voltage due to a voltage IR drop of the power voltage wiring network may be input to the pixel circuit, the pixel circuit may be configured to transfer the pixel power voltage to the emission device according to a logic level of a data signal input in a subfield unit, and the emission device may be coupled to the pixel circuit and may be configured to emit light having a brightness corresponding to the pixel power voltage.

The pixel circuit may include: a first thin film transistor configured to be turned on according to a scan signal applied via a gate line and to transmit the data signal applied via a source line; a second thin film transistor configured to be turned on according to the logic level of the data signal and to transfer the pixel power voltage to the emission device; and a first capacitor configured to maintain a turn-on status or a turn-off status of the second thin film transistor according to the logic level of the data signal.

According to one or more embodiments of the present invention, an organic light-emitting display apparatus includes: a first pixel including a first pixel circuit and a first emission device electrically insulated from the first pixel circuit; a first dummy circuit configured to control the first emission device to emit light; a first repair line configured to electrically couple the first dummy circuit and the first emission device of the first pixel; and a power voltage generation unit configured to generate a first dummy power voltage having a same level as that of a first pixel power voltage input to the first pixel circuit and to output the first dummy power voltage to the first dummy circuit.

A level of the first dummy power voltage may vary according to a variation of the level of the first pixel power voltage due to a voltage IR drop.

The power voltage generation unit may be further configured to generate a first power voltage and to output the first power voltage to the first pixel circuit, and the level of the first pixel power voltage may be lower than that of the first power voltage due to a voltage IR drop.

The organic light-emitting display apparatus may further include: a second pixel including a second pixel circuit and a second emission device electrically insulated from the second pixel circuit; a second dummy circuit configured to control the second emission device to emit light; and a second repair line configured to electrically couple the second dummy circuit and the second emission device of the second pixel, and the power voltage generation unit may be further configured to generate a second dummy power voltage having a same level as that of a second pixel power voltage input to the second pixel circuit and to output the second dummy power voltage to the second dummy circuit.

According to one or more embodiments of the present invention, an organic light-emitting display apparatus includes: a power voltage generation unit configured to generate a first power voltage and a plurality of first dummy power voltages; a power voltage wiring network to which the first power voltage is applied; a plurality of pixels each including an emission device and a pixel circuit coupled to the power voltage wiring network; a plurality of first dummy power voltage lines to which the plurality of first dummy power voltages are applied; and a plurality of first dummy circuits respectively connectable to the plurality of first dummy power voltage lines.

The organic light-emitting display apparatus may further include: a plurality of second dummy power voltage lines; a plurality of second dummy circuits respectively connectable to the plurality of second dummy power voltage lines, and the power voltage generation unit may be further configured to generate a plurality of second dummy power voltages respectively applied to the plurality of second dummy power voltage lines, and the plurality of pixels may be between the plurality of first dummy power voltage lines and the plurality of second dummy power voltage lines.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
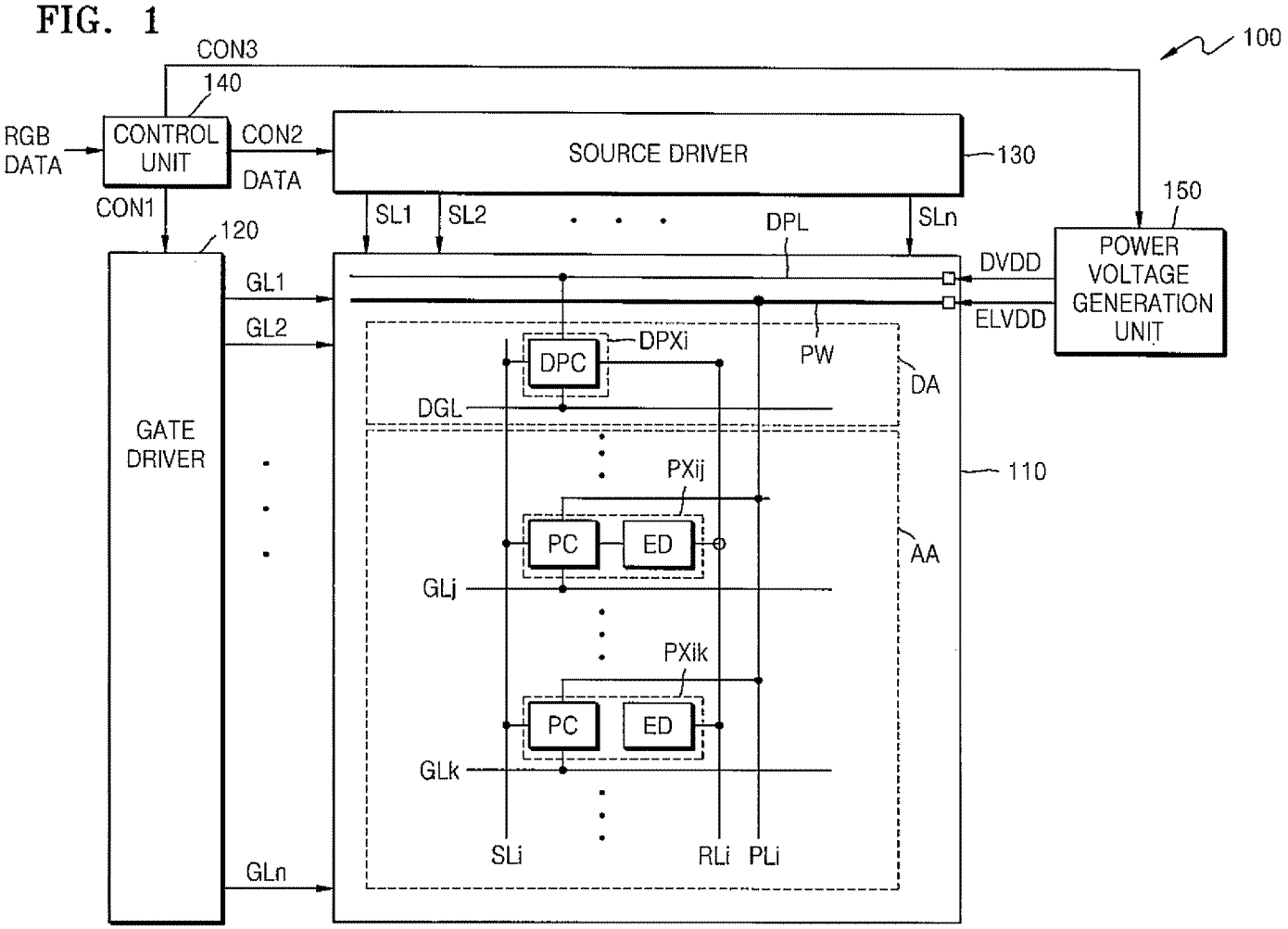
FIG. 1 is a schematic block diagram of an organic light-emitting display apparatus according to an embodiment of the present invention.

Reference will now be made in more detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items.

In the accompanying drawings, those components that are the same or are in correspondence are rendered the same reference numeral regardless of the figure number, and redundant explanations may not be provided again.

Throughout the specification, while terms "first" and "second" are used to describe various components, it is obvious that the components are not limited to the terms "first" and "second". The terms "first" and "second" are used only to distinguish between each component. Throughout the specification, a singular form may include plural forms, unless there is a particular description contrary thereto. Also, terms such as "comprise" or "comprising" are used to specify existence of a recited form, and/or a component, not excluding the existence of one or more other recited forms, and/or one or more other components.

FIG. 1 is a schematic block diagram of an organic light-emitting display apparatus 100 according to an embodiment of the present invention.

Referring to FIG. 1, the organic light-emitting display apparatus 100 includes a display panel 110, a gate driver 120, a source driver 130, a control unit 140, and a power voltage generation unit 150.

The display panel 110 may include a power voltage wiring network, a dummy power voltage line DPL, pixels PX such as pixels PXij, PXik, dummy pixels DPX such as a dummy pixel DPXi, gate lines GL such as gate lines GL1-GLm, a dummy gate line DGL, source lines SL such as source lines SL1-SLn, and repair lines RL such as a repair line RLi. The power voltage generation unit 150 generates a first power voltage ELVDD and a dummy power voltage DVDD. The power voltage wiring network includes a power voltage wiring PW to which the first power voltage ELVDD is applied, and power voltage lines PL such as a power voltage line PLi coupled to (e.g., connected to) the power voltage wiring PW. The dummy power voltage DVDD is applied to the dummy power voltage line DPL. Each of the pixels PX includes a pixel circuit PC electrically connected to the power voltage lines PL, and an emission device ED. Each of the dummy pixels DPX includes a dummy circuit DPC arranged or configured to be connectable to the dummy power voltage line DPL. Each of the repair lines RL is located such that they can be coupled to the dummy circuit DPC of the corresponding dummy pixel DPX (for example, the dummy pixel DPX arranged in the same column) and the emission devices ED of the corresponding pixels PX (for example, the pixels PX arranged in the same column).

The display panel 110 includes an active area AA in which the pixels PX are located and a dummy area DA in which the dummy pixels DPX are located. Although the dummy area DA of FIG. 1 is located at an upper side of the active area AA, the dummy area DA may be located at a lower side of the active area AA. As another example, the dummy area DA may be located at both upper and lower sides of the active area AA. In this case, the number of repairable pixels may be increased twice.

As another example, the dummy area DA may be located at a left side of the active area AA, at a right side, or both the left and right sides. In this case, the repair lines RL may extend in a row direction, the dummy pixels DPX may be connected to gate lines connected to the pixels PX of the same row and separate dummy source lines. For better understanding, although, in the present specification, the dummy area DA is provided in the upper and/or lower sides of the active area AA as shown in FIG. 1, the present invention is not limited thereto.

The display panel 110 includes the pixels PX, the gate lines GL, and source lines SL. The pixels PX may be connected to the gate lines GL and the source lines SL, and may be arranged in a matrix at a point where the gate lines GL and the source lines SL cross each other. FIG. 1 illustrates only the pixels PXij and PXik connected to (or coupled to) the source line SLi and the gate line GLj and GLk. In the present specification, a direction in which the gate lines GL extend is referred to as a row direction, and a direction in which the source lines SL extend is referred to as a column direction.

The display panel 110 includes the power voltage wiring network to which the first power voltage ELVDD is applied. The power voltage wiring network includes the power voltage wiring PW to which the first power voltage ELVDD is applied, and the power voltage lines PL connected to the power voltage wiring PW. The power voltage wiring PW has a large cross-sectional area and a low line resistance in a length direction compared to the power voltage lines PL. Although the power voltage wiring PW is illustrated as being positioned at upper sides of the pixels PX in FIG. 1, the power voltage wiring PW may be positioned at lower sides of the pixels PX, at both upper and lower sides, and at left and/or right sides. The power voltage lines PL are commonly connected to the power voltage wiring PW and provide paths for supplying driving voltages of the pixels PX from the power voltage wiring PW. The power voltage lines PL may extend in the column direction from the power voltage wiring PW. As another example, the power voltage lines PL may extend in the row direction or may be arranged in a mesh shape according to a position of the power voltage wiring PW.

The driving voltages are voltages for driving the pixels PX. Current consumed by the pixels PX flows through the power voltage lines PL. A voltage IR drop which is in proportional to a size of the current and line resistances of the power voltage lines PL takes place in the power voltage lines PL. Voltage levels of the driving voltages may be different according to positions of the pixels PX. In the present specification, a driving voltage of a specific pixel (for example, the pixel PXij) is referred to as a pixel power voltage PVDDij. It is defined that the pixel power voltage PVDDij has a voltage level of a node in which the pixel PXij and a power voltage line PLi meet each other. For example, a level of the pixel power voltage PVDDij of the pixel PXij is higher than that of a pixel power voltage PVDDik.

Each of the pixels PX includes the pixel circuit PC and the emission device ED. The pixel circuit PC includes at least one thin film transistor and at least one capacitor. The pixel circuit PC is connected to the power voltage line PL, the gate line GL, and the source line SL. The emission device ED is connected to the pixel circuit PC and is arranged or configured to be connectable to the repair line RL. The emission device ED may be separably connected to the pixel circuit PC.

As an example, the pixel circuit PC may provide an output to the emission device ED by generating a driving current corresponding to a data signal applied via the source line SL, and the emission device ED may emit light having brightness corresponding to the data signal. Such a method is referred to as an analog driving method.

As another example, the pixel circuit PC may transmit (or provide) a pixel power voltage PVDD that is input to the pixel circuit PC according to a logic level of the data signal applied via the source line to the emission device ED. The emission device ED may emit light by receiving the pixel power voltage PVDD. The emission device ED has different brightness according to a level of the pixel power voltage PVDD. For example, the higher the level of the pixel power voltage PVDD is, the brighter the light may be emitted by the emission device ED. Such a method may be referred to as a digital driving method.

The display panel 110 may include the dummy pixels DPX and the dummy gate line DGL. The dummy pixels DPX are connected to the dummy gate line DGL and the source lines SL. For example, the dummy pixel DPXi is connected to the dummy gate line DGL and the source line SLi. FIG. 1 illustrates only the dummy pixel DPXi connected to the source line SLi and the dummy gate line DGL. As an example, the dummy gate line DGL may be connected to and driven by the gate driver 120 or may be concurrently (or simultaneously) driven with the other gate line GL (for example, the gate line GLk) or may be driven at a different time. As another example, if a defective pixel (for example, PXik) that is to be repaired is specified, the gate line GLk connected to the defective pixel PXik may be connected to the dummy pixel DPXi via a separate connection line. In this case, the defective pixel PXik and the dummy pixel DPXi may concurrently (or simultaneously) receive a scan signal and the data signal. The dummy pixels DPX may be driven by using (or utilizing) various suitable methods. The dummy pixel DPX includes the dummy circuit DPC.

The display panel 110 includes the repair lines RL. The repair lines RL may then extend in the column direction. The repair lines RL may extend in the row direction according to positions of the dummy pixels DPX. Each of the repair lines RL may be arranged or configured to be connectable to the dummy circuit DPC of the corresponding dummy pixel DPX and the emission devices ED of the corresponding pixels PX. In FIG. 1, each of the repair lines RL is arranged or configured to be connectable to the dummy circuit DPC of the dummy pixel DPX positioned in the same column and the emission devices ED of the pixels PX positioned in the same column. As another example, when the repair lines RL extend in the row direction, each of the repair lines RL is arranged or configured to be connectable to the dummy circuit DPC of the dummy pixel DPX positioned in the same row and the emission devices ED of the pixels PX positioned in the same row.

In the present specification, the term "connectable" or "connectably" refers to a connectable state by using (or utilizing) laser during a repair process. A first member and a second member are connectably disposed (or arranged or configured to be connectable) refers to the first and second members being in a connectable state during the repair process while the first and second members are not actually connected to each other. For example, the first and second members that are "connectable" to each other may be arranged to overlap with each other with an insulating layer positioned therebetween in an overlapping area. If laser is irradiated on the overlapping area during the repair process, the insulating layer is destructed in the overlapping area, and the first and second members are electrically connected to each other. The first and second members that are "connectable" to each other may be respectively connected to a first conductive member and a second conductive member that are connectable to each other.

The emission device ED of the pixel PXij is connectably disposed in the repair line RLi. FIG. 1 illustrates a part at which wiring connected to the emission device ED of the pixel PXij and the repair line RLi cross each other as a hollow circle. The emission device ED of the pixel PXik is connected to the repair line RLi. FIG. 1 illustrates a node to which wiring connected to the emission device ED of the pixel PXik and the repair line RLi are connected as a stuffed circle (or a bold point) by a suitable method.

In the present specification, the terms "separable" and "separably" refer to a separable state by using (or utilizing) laser during a repair process. A first member and a second member are separably disposed refers to the first and second members being in a separable state during the subsequent repair process while the first and second members are actually connected to each other. For example, the first and second members that are "separably" connected to each other may be connected to each other via a conductive connection member. If laser is irradiated on the conductive connection member during the repair process, a part of the conductive connection member on which laser is irradiated is melt and cut, and the first and second members are electrically separated and insulated from each other. As an example, the conductive connection member may include a silicon pattern that may be melted by irradiating laser. For example, the first and second members may be connected to each other via the silicon pattern. As another example, the conductive connection member may be melted and cut according to Joule heat generated from current. As another example, the conductive connection member may be a thin metal pattern.

In FIG. 1, the pixel PXij is a pixel that normally operates, and the pixel PXik is a pixel repaired by the dummy pixel DPXi. If the pixel circuit PC of the repaired pixel PXik is defective, the pixel circuit PC of the pixel PXik is electrically separated from the emission device ED by irradiating laser during a repair process. The emission device ED of the pixel PXik is electrically connected to the dummy pixel DPC of the dummy pixel DPXi through the repair line RLi. The data signal and the scan signal applied to the pixel circuit PC of the pixel PXik are applied to the dummy circuit DPC through the source line SLi and the dummy gate line DGL. The dummy circuit DPC drives the emission device ED of the pixel PXik instead of the pixel circuit PC of the pixel PXik.

As described above, a level of the pixel power voltage PVDD input to the pixels PX may vary due to the voltage IR drop. A size of the voltage IR drop also varies according to a displayed image. For example, when a bright image is displayed, because the size of current consumed by the pixels PX increases, the size of the voltage IR drop increases. When a dark image is displayed, because the size of current consumed by the pixels PX decreases, the size of the voltage IR drop decreases. However, the level of the pixel power voltage PVDD gradually varies over the whole screen, and thus the level may not be visibly recognized by an observer.

In the repaired pixel PXik, the pixel power voltage PVDDik is input to the pixel circuit PC of the pixel PXik. However, the dummy pixel DPC of the dummy pixel DPXi adjacent to the power voltage wiring PW is connected to the power voltage line RLi, a power voltage having the same level (or substantially the same level) as that of the first power voltage ELVDD is input to the dummy circuit DPC. The emission device ED of the repaired pixel PXik is driven by the dummy circuit DPC of the dummy pixel DPXi, and thus the emission device ED of the pixel PXik emits brighter light than that of the emission device ED of the adjacent pixels PX. Such a phenomenon may be visibly recognized by the observer. This problem may be an even greater issue when the organic light-emitting display apparatus 100 operates according to the digital driving method.

According to the present embodiment, the emission device ED of the repaired pixel PXik may emit light similarly to the neighboring other pixels PX by inputting the dummy power voltage DVDD of the same level (or substantially the same level) as that of the pixel power voltage PVDDik to the dummy circuit DPC of the dummy pixel DPXi. In this case, the emission device ED of the repaired pixel PXik may not be visibly recognized by the observer.

According to the present embodiment, the display panel 110 includes the dummy power voltage line DPL to which the dummy power voltage DVDD generated by the power voltage generation unit 150 is applied, and the dummy pixel DPX is arranged or configured to be connectable to the dummy power voltage line DPL. The level of the dummy power voltage DVDD is lower than that of the first power voltage ELVDD.

If the dummy pixel DPXi used to repair the dummy pixel DPX is determined, the dummy pixel DPXi is connected to the dummy power voltage line DPL. The power voltage generation unit 150 generates the dummy power voltage DVDD of the same level (or substantially the same level) as that of the pixel power voltage PVDDik that is input to the pixel circuit PC of the repaired pixel PXik and supplies the dummy power voltage DVDD to the dummy pixel DPXi. As described above, the level of the pixel power voltage PVDDik varies according to a display image. For example, when the pixels PX connected to the power voltage line PLi consumes a great amount of current, the level of the pixel power voltage PVDDik is reduced, and, when the pixels PX connected to the power voltage line PLi consumes a small amount of current, the level of the pixel power voltage PVDDik increases. Thus, the level of the dummy power voltage DVDD may be time variant (i.e., may vary in time).

The control unit 140 may receive image data RGB DATA from the outside and control the gate driver 120, the source driver 130, and the power voltage generation unit 150. The control unit 140 may generate a plurality of control signals CON1, CON2, and CON3, and digital image data DATA. The control unit 140 may provide the first control signal CON1 to the gate driver 120, provide the second control signal CON2 and the digital image data DATA to the source driver 130, and provide the third control signal CON3 to the power voltage generation unit 150.

The gate driver 120 may sequentially drive the gate lines GL in response to the first control signal CON1. For example, the first control signal CON1 may be an instruction signal for instructing the gate driver 120 to start scanning the gate lines GL1-GLm. The gate driver 120 may generate the scan signal and sequentially provide the scan signal to the pixels PX and the dummy pixels DPX via the gate lines GL.

The source driver 130 may drive the source lines SL in response to the second control signal CON2 and the digital image data DATA. The source driver 130 may convert the digital image data DATA having gradation into data signals having gradation voltages corresponding to the gradation and sequentially provide the data signals to the pixels PX and the dummy pixels DPX via the source lines SL.

The gate driver 120, the source driver 130, and the control unit 140 may be formed in separate semiconductor chips or may be integrated into one semiconductor chip. The gate driver 120, along with the display panel 110, may be formed on the same substrate.

The power voltage generation unit 150 may generate the first power voltage ELVDD, and the dummy power voltage DVDD in response to the third control signal CON3 and supply the first power voltage ELVDD and the dummy power voltage DVDD to the display panel 110. The third control signal CON3 may be a signal for determining a level of the first power voltage ELVDD and a level of the dummy power voltage DVDD. The power voltage generation unit 150 may generate the dummy power voltage DVDD having a time-variant level.

As another example, the organic light-emitting display apparatus 100 may be driven according to the digital driving method. One frame is composed of a plurality of subfields of which display continuation time is determined according to a set weight. The gate driver 120 may supply the scan signal to the display panel 110 several times at previously determined timing within a frame via the gate lines GL and the dummy gate line DGL. The data driver 130 may supply a data signal having a first logic level or a second logic level to the pixels PX and the dummy pixels DPX via the source lines SL at a time when activated scan signals are input to the pixels PX and the dummy pixels DPX. The first logic level may be a high level, and the second logic level may be a low level. To the contrary, the first logic level may be a low level, and the second logic level may be a high level.

The source driver 130 may receive the digital image data DATA from the control unit 140, extract gradation for each of the pixels PX, and convert the extracted gradation into digital data of a previously determined number of bits. The source driver 130 may provide each bit included in the digital image data DATA to each of the pixels PX as a data signal for each corresponding subfield.

The organic light-emitting display apparatus 100 may selectively emit the emission device ED included in each of the pixels PX based on a logic level of the data signal provided from the source driver 130 for each subfield, and adjust an emission time of the emission device ED within one frame, thereby displaying gradation. Each of the pixels PX may emit the emission device ED during a corresponding subfield section, for example, when the data signal of the low level is received, and may not emit the emission device ED during the corresponding subfield section, for example, when the data signal of the high level is received.

The organic light-emitting display apparatus 100 driven according to the digital driving method will now be described in more detail with reference to FIGS. 2 and 3.

When the dummy pixel DPXi is used (or utilized) to repair the pixel PXik, the control unit 140 may control the power voltage generation unit 150 such that the level of the dummy power voltage DVDD is substantially the same as that of the pixel power voltage PVDDik that is input to the pixel PXik. The control unit 140 may store information regarding a position or a coordinate of the repaired pixel PXik. The control unit 140 may estimate the level of the pixel power voltage PVDDik based on the position of the pixel PXik and the image data RGB DATA. The control unit 140 may control the power voltage generation unit 150 such that the level of the dummy power voltage DVDD is the same as the estimated level of the pixel power voltage PVDDik.

For example, when the image data RGB DATA has large values, the pixels PX may consume a large amount of current to emit brighter light. As size of the voltage IR drop increases, the level of the pixel power voltage PVDDik decreases. The control unit 140 may estimate that the level of the pixel power voltage PVDDik is reduced based on at least a part of the image data RGB DATA.

The control unit 140 may determine a size of current flowing through the power voltage line PLi to which the pixel PXik is connected based on the image data RGB DATA. The control unit 140 may determine the level of the dummy power voltage DVDD based on the determined size of current. The control unit 140 may control the power voltage generation unit 150 to generate the dummy power voltage DVDD of the determined level. When the size of current flowing through the power voltage line PLi is determined, the image data RGB DATA corresponding to the pixels PX connected to the power voltage line PLi, for example, the pixels PX positioned in the same column as that of the power voltage line PLi, may be used.

The image data RGB DATA may vary for each frame. The control unit 140 may determine the level of the dummy power voltage DVDD for each frame. The level of the dummy power voltage DVDD may vary for each frame.

Figure 2:
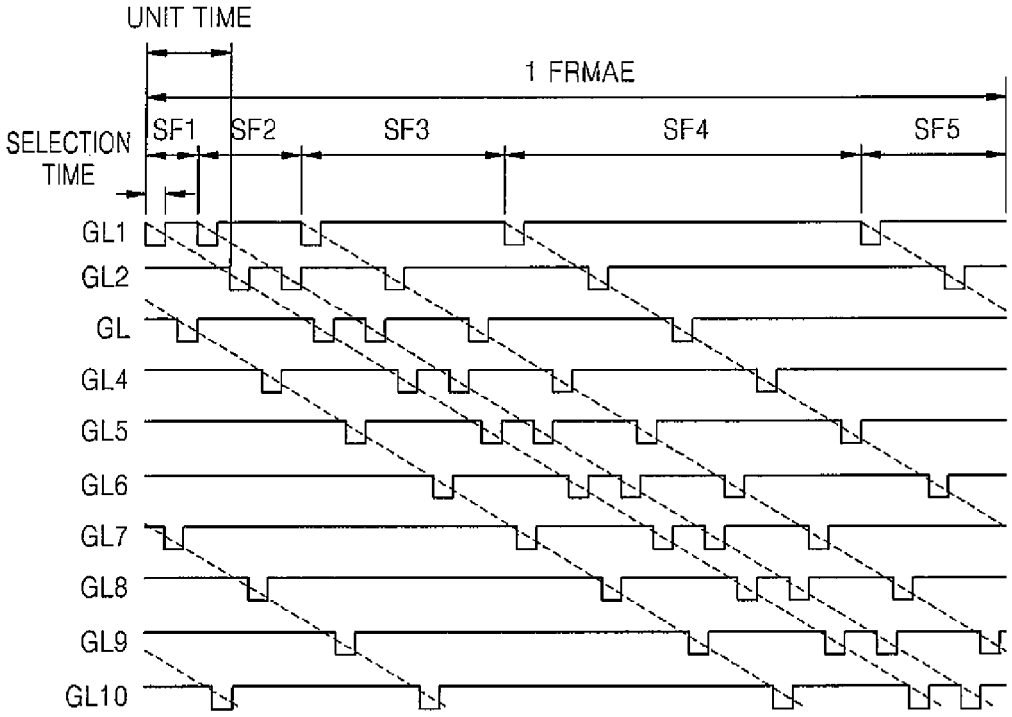
FIG. 2 is a timing diagram of an example of controlling first through tenth gate lines.

FIG. 2 is a timing diagram of an example of controlling the first through tenth gate lines GL1-GL10.

Referring to FIG. 2, one frame is composed of, for example, first through fifth subfields SF1 through SF5 and displays gradation by first through fifth bit data. One unit time includes five selection times. A length of display continuation time of each piece of bit data is 3:6:12:21:8. A sum of the display continuation time of the first through fifth bit data is 50 (=3+6+12+21+8) selection times. Selection timing of each gate line GL for each of the first through fifth subfields SF1 through SF5 is delayed by one unit time compared to selection timing of the previous gate line GL. The fifth subfield SF5 may be a non-emission time. The fifth bit data may be non-active (or non-emission) bit data. In this case, one frame displays gradation by the first through fourth bit data.

One unit time is time-divided into five selection times such that only one gate line GL may be selected at one selection time. For example, within first unit time, the first gate line GL1, the seventh gate line GL7, the third gate line GL3, the first gate line GL1, and the tenth gate line GL10 are sequentially selected at the first through fifth selection times, respectively, and the first bit data, the fourth bit data, the fifth bit data, the second bit data, and the third bit data are applied to the respective pixels PX.

For example, the tenth gate line GL10 may be the dummy gate line GL. When the display panel 100 normally operates without a repair, non-active bit data may be input at the timing when the tenth gate line GL10 is selected. When the dummy pixel DPX connected to the tenth gate line GL10 is used (or utilized) for repair, bit data applied to the pixel PX repaired by using (or utilizing) the dummy pixel DPX may be applied to the dummy pixel DPX at the timing when the tenth gate line GL10 is selected.

Figure 3:
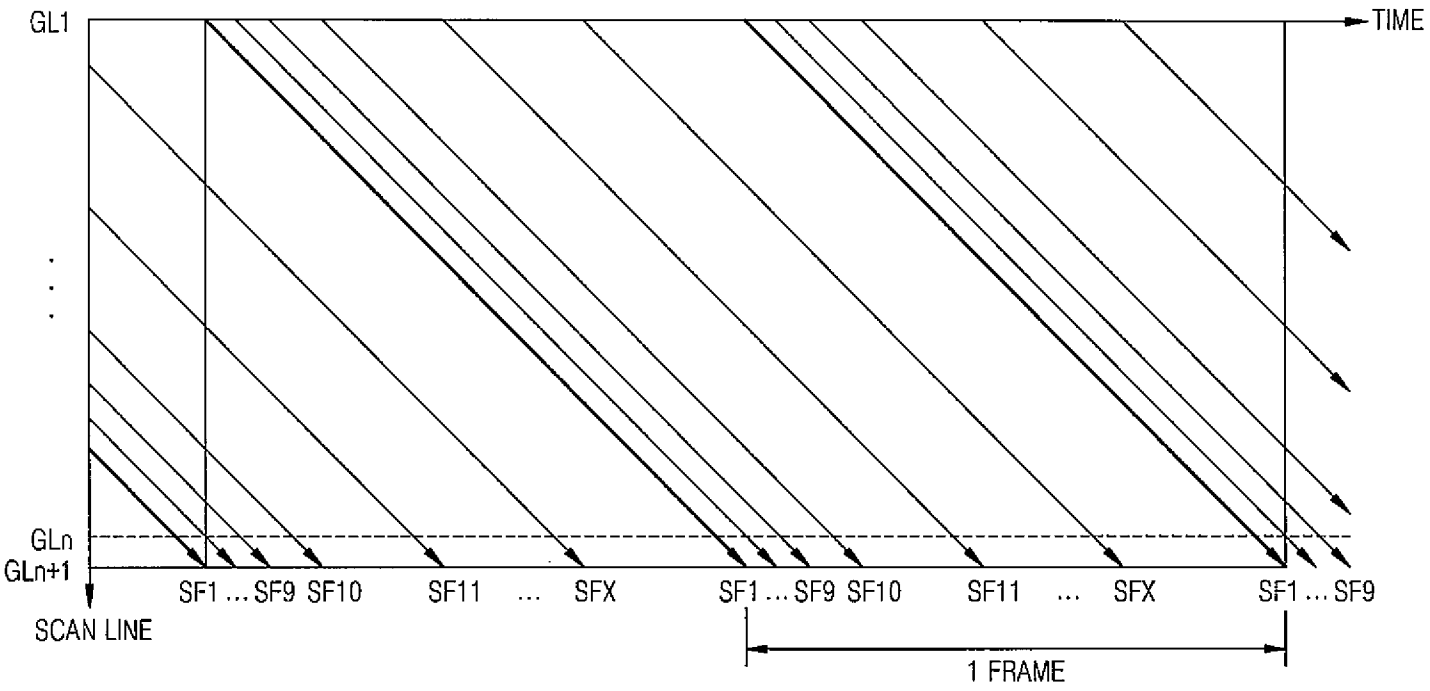
FIG. 3 is a timing diagram of an example of controlling first through $n+1^{th}$ gate lines.

FIG. 3 is a timing diagram of an example of controlling the first through $n+1^{th}$ gate lines GL1 through GLn+1.

Referring to FIG. 3, one frame is composed of first through Xth subfields SF1 through SFX and displays gradation by first through Xth bit data. One unit time includes five selection times. Selection timing of each gate line GL for each of the first through Xth subfields SF1 through SFX is delayed by one unit time compared to selection timing of the previous gate line GL. One unit time is time-divided into a plurality of selection times such that only one gate line GL may be selected at one selection time.

For example, the last n+1th gate line GLn+1 may be the dummy gate line DGL. When the display panel 100 normally operates without a repair, non-active bit data may be input at the timing when the n+1th gate line GLn+1 is selected. When the dummy pixel DPX connected to the n+1th gate line GLn+1 is used for repair, bit data applied to the pixel PX repaired by using the dummy pixel DPX may be applied to the dummy pixel DPX at the timing when the n+1th gate line GLn+1 is selected.

Figure 4:
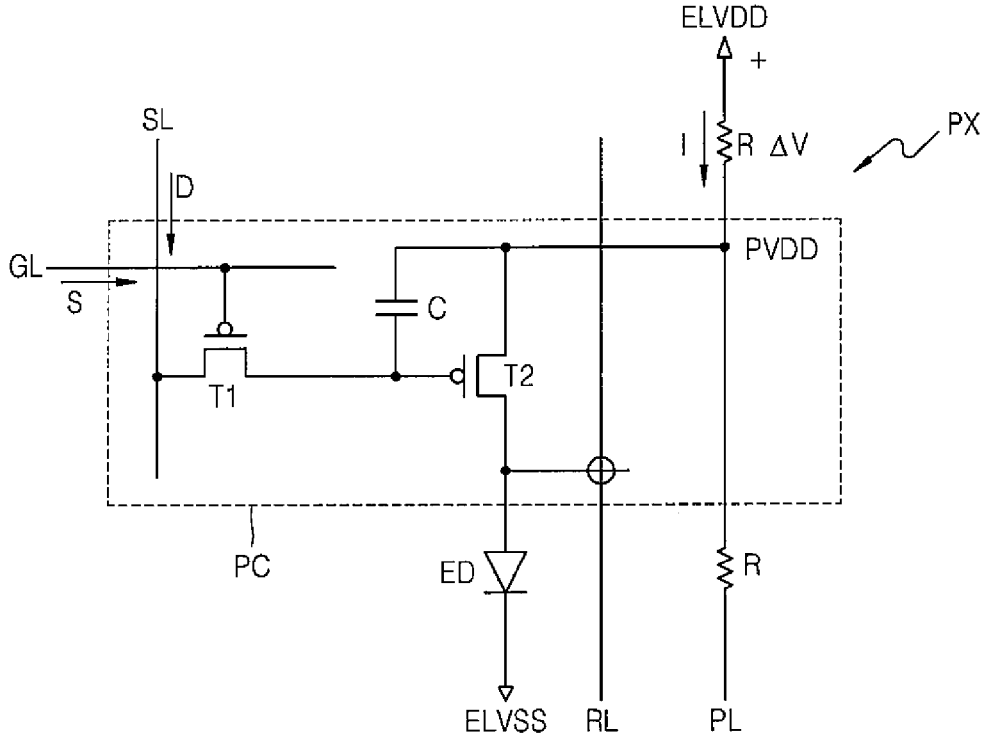
FIG. 4 is a circuit diagram of a pixel according to an embodiment of the present invention.

FIG. 4 is a circuit diagram of the pixel PX according to an embodiment of the present invention.

Referring to FIG. 4, the pixel PX includes the pixel circuit PC including two transistors T1 and T2 and one capacitor C, and the emission device ED connected to the pixel circuit PC. The pixel circuit PC and the emission device ED may be separably connected to each other, and may be separated from each other during a repair process.

The emission device ED may be an organic light-emitting diode (OLED) including a first electrode, a second electrode facing the first electrode, and an emission layer between the first and second electrodes. The first and second electrodes may be anode and cathode electrodes, respectively. The anode electrode of the emission device ED may be connected to the second electrode of the second transistor T2, and the cathode electrode thereof may receive a second power voltage ELVSS generated by, for example, the power voltage generation unit 150. The anode electrode of the emission device ED may be configured to be connectable to the repair line RL with an insulating layer arranged therebetween. The first power voltage ELVDD may be a set or predetermined high level voltage. The second power voltage ELVSS may be a voltage lower than the first power voltage ELVDD or may be a ground voltage.

The first transistor T1 includes a gate electrode connected to the gate line GL, a first electrode connected to the source line SL, and a second electrode connected to the gate electrode of the second transistor T2. If the first transistor T1 is turned on by a scan signal S applied to the gate electrode, a data signal D applied via the source line SL is transmitted to the gate electrode of the second transistor T2. The capacitor C includes a first electrode that is connected to the second electrode of the first transistor T1 and the gate electrode of the second transistor T2, and a second electrode connected to the first electrode of the second transistor T2. The second transistor T2 includes a gate electrode connected to the second electrode of the first transistor T1, a first electrode connected to the power voltage line PL, and a second electrode connected to the anode electrode of the emissions device ED.

As shown in FIG. 1, the first power voltage ELVDD generated by the power voltage generation unit 150 is applied to the power voltage line PL via the power voltage wiring PW. As described above, current I consumed by emitting the emission device ED flows through the power voltage line PL. The many pixels PX are connected to the power voltage line PL, and thus a sum of the current I consumed by the emission device ED of the pixels PX is not a negligible size. The power voltage line PL is a conductive pattern having a line resistance, and thus being understood as having resistance R. A voltage IR drop $\Delta V$, as much as multiplication of the current I and the resistance R, is generated between a point to which the first power voltage ELVDD of the power voltage line PL is applied and a point connected to the pixel PX of the power voltage line PL. Thus, a level of the pixel power voltage PVDD input to the pixel PX is lower by the voltage IR drop $\Delta V$ more than just a level of the first power voltage ELVDD.

When the organic light-emitting display apparatus 100 operates according to an analog driving method, the capacitor C stores a voltage of the data signal D, and the second transistor T2 generates a driving current corresponding to the voltage stored in the capacitor C and transfers the driving current to the emission device ED. The emission device ED receives the driving current and emits light having brightness corresponding to the driving current.

When the organic light-emitting display apparatus 100 operates according to a digital driving method, the second transistor T2 is turned on or off according to a logic level of the data signal D applied to the gate electrode, and, when being turned on, transfers the pixel power voltage PVDD to the first electrode (for example, the anode electrode) of the emission device ED. The capacitor C may maintain a turn-on status or a turn-off status of the second transistor T2. When the second transistor T2 is turned on, the pixel power voltage PVDD is transferred to the anode electrode of the emission device ED via the second transistor T2. The emission device ED emits light if the pixel power voltage PVDD is applied to the anode electrode. The emission device ED emits light having brightness corresponding to the pixel power voltage PVDD. If the second transistor T2 is turned off, and the pixel power voltage PVDD is not applied to the anode electrode, the emission device ED does not emit light and displays black. An example of operating the organic light-emitting display apparatus 100 according to the digital driving method will be described below. However, various embodiments of the present invention may be applied to the organic light-emitting display apparatus 100 that operates according to the analog driving method.

Figure 5:
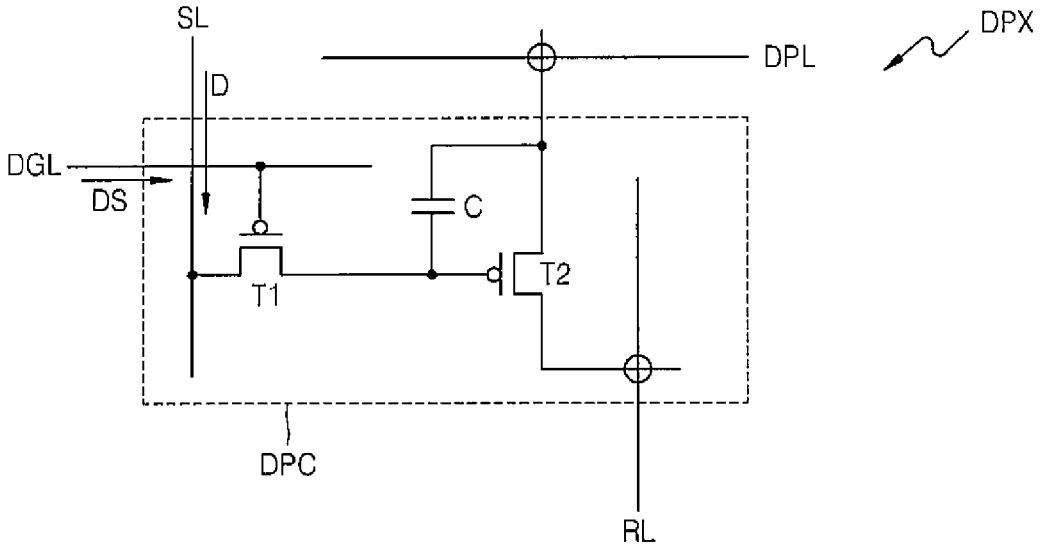
FIG. 5 is a circuit diagram of a dummy pixel according to an embodiment of the present invention.

FIG. 5 is a circuit diagram of the dummy pixel DPX according to an embodiment of the present invention.

Referring to FIG. 5, the dummy pixel DPX includes the dummy circuit DPC. The dummy circuit DPC includes the first transistor T1, the second transistor T2, and the capacitor C similarly to the pixel circuit PC.

The first transistor T1 of the dummy circuit DPC includes a gate electrode connected to the dummy gate line DGL, a first electrode connected to the source line SL, and a second electrode connected to a gate electrode of the second transistor T2. The second transistor T2 of the dummy circuit DPC includes a gate electrode connected to the second electrode of the first transistor T1, a first electrode configured to be connectable to the dummy power voltage line DPL, and a second electrode configured to be connectable to the repair line RL. The capacitor C includes a first electrode connected to the second electrode of the first transistor T1 and the gate electrode of the second transistor T2, and a second electrode connected to the first electrode of the second transistor T2.

When the dummy circuit DPC is used to repair a defective pixel during a repair process, the first electrode of the second transistor T2 is connected to the dummy power voltage line DPL, and the second electrode of the second transistor T2 is connected to the repair line RL. The second repair line RL is connected to an anode electrode of an emission device of the defective pixel. The emission device of the defective pixel is electrically separated from the pixel circuit PC.

The dummy circuit DPC receives a dummy scan signal DS via the dummy gate line DGL. The dummy scan signal DS may be received by the dummy circuit DPC at the same timing as that of the scan signal S applied to the defective pixel. As another example, the dummy scan signal DS may be received by the dummy circuit DPC at different timing from that of the scan signal S applied to the defective pixel. The dummy circuit DPC receives the same data signal D as the data signal D applied to the defective pixel at a time when the activated scan signal S is received. The second transistor T2 is turned on or off according to a logic level of the data signal D. If the second transistor T2 is turned on, the dummy power voltage DVDD applied via the dummy power voltage line DPL is transferred to the emission device of the defective pixel via the repair line RL. The emission device of the defective pixel emits light when receiving the dummy power voltage DVDD.

Figure 6:
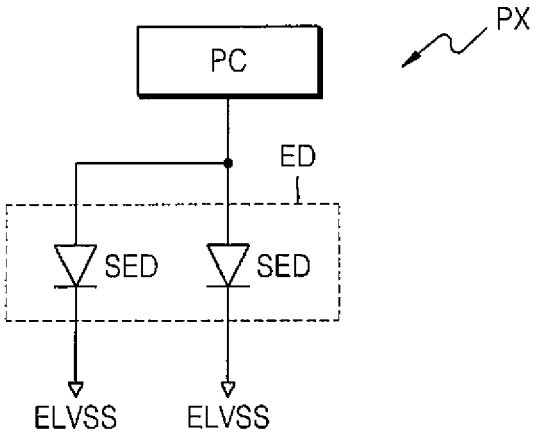
FIG. 6 is a schematic circuit diagram of a pixel according to another embodiment of the present invention.

FIG. 6 is a schematic circuit diagram of the pixel PX according to another embodiment of the present invention.

Referring to FIG. 6, the pixel PX includes the pixel circuit PC and the emission device ED. The emission device ED may include a plurality of sub emission devices SED. The present invention is not limited to the number of the sub emission devices SED included in the emission device ED.

The emission device Ed may include a plurality of first electrodes commonly connected to the pixel circuit PC, a second common electrode facing the first electrodes, and a plurality of emission layers arranged between the first electrodes and the second common electrode.

As described above, the anode electrode of the emission device ED may be configured to be connectable to the repair line RL. When one of the sub emission devices SED is defective, although the other sub emission devices SED is normal, all the sub emission devices ED do not emit light. In this case, the other sub emission devices SED may emit light by separating the anode electrode of the defective sub emission device SED from the pixel circuit PC. In this case, an amount of the emitted light is reduced.

According to an embodiment, the other sub emission devices SED may be electrically separated from the pixel circuit PC and may be connected to the repair line RL. The other sub emission devices SED may emit light having the same brightness as that of light emitted by all the sub emission devices SED included in the emission device ED by increasing a level of the dummy power voltage DVDD applied to the dummy circuit DPC connected to the repair line RL.

Figure 7:
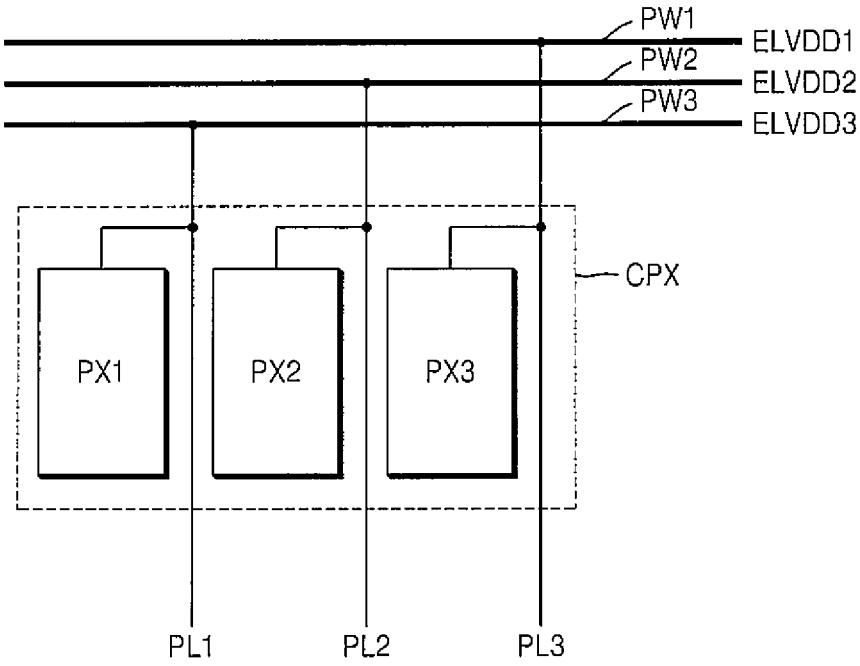
FIG. 7 is a schematic view of pixels according to an embodiment of the present invention.

FIG. 7 is a schematic view of pixels PX1, PX2, and PX3 according to an embodiment of the present invention.

The organic light-emitting display apparatus 100 may display a color image. To display the color image, the organic light-emitting display apparatus 100 includes unit color pixels CPX composed of the pixels PX1, PX2, and PX3. The unit color pixels CPX may be arranged in a matrix. Each of the pixels PX1, PX2, and PX3 displays one color image. As an example, the unit color pixel CPX includes the three pixels PX1, PX2, and PX3 that respectively display red R, green G, and blue B. As another example, the unit color pixel CPX may include the four pixels PX that respectively display red R, green G, blue B, and white W.

For example, the first pixel PX1 may include a red emission layer that emits light of red R (emits red light), the second pixel PX2 may include a green emission layer that emits light of green G (emits green light), and the third pixel PX3 may include light of a blue emission layer that emits light of blue B (emits blue light). The red emission layer, the green emission layer, and the blue emission layer may have different operating voltages.

The first pixel PX1 may be connected to a first power voltage line PL1. The first power voltage line PL1 may be connected to a first power voltage wiring PW1 to which a first color power voltage ELVDD1 is applied. The second pixel PX2 may be connected to a second power voltage line PL2. The second power voltage line PL2 may be connected to a second power voltage wiring PW2 to which a second color power voltage ELVDD2 is applied. The third pixel PX3 may be connected to a third power voltage line PL3. The third power voltage line PL3 may be connected to a third power voltage wiring PW3 to which a third color power voltage ELVDD3 is applied. The first through third color power voltages ELVDD1-ELVDD3 may have different levels.

The power voltage generation unit 150 may generate the first through third color power voltages ELVDD1-ELVDD3. The power voltage generation unit 150 may include a first power chip generating the first color power voltage ELVDD1, a second power chip generating the second color power voltage ELVDD2, a third power chip generating the third color power voltage ELVDD3, and a fourth power chip generating the dummy power voltage DVDD. The dummy power voltage DVDD may be plural. The fourth power chip may be a multichannel power chip. The first through third power chips may output greater power than that of the fourth power chip. As another example, the power voltage generation unit 150 may include the first through third color power voltages ELVDD1-ELVDD3 and a multichannel power chip generating the dummy power voltage DVDD.

Figure 8:
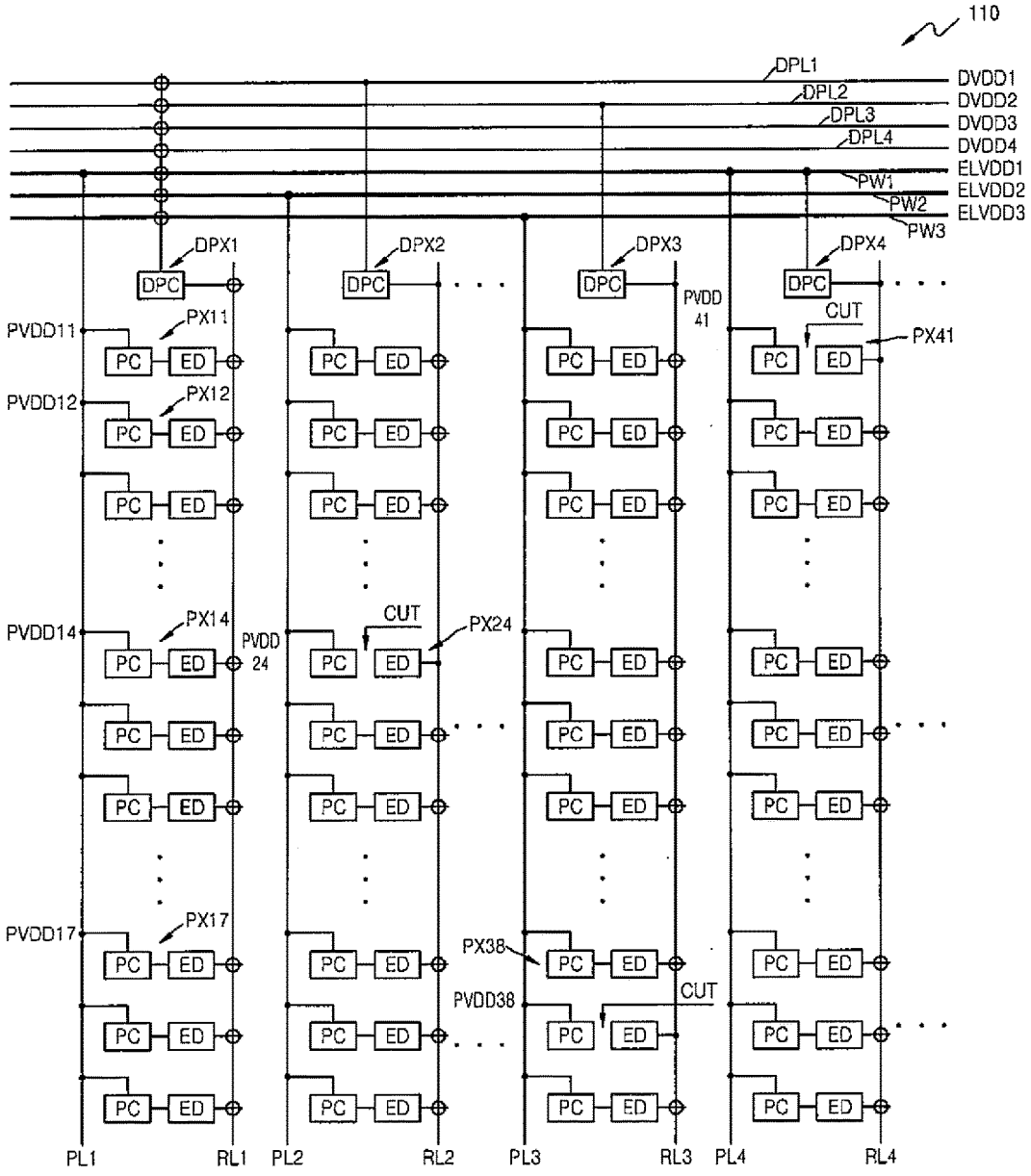
FIG. 8 is a schematic view of a display panel according to an embodiment of the present invention.

FIG. 8 is a schematic view of a display panel 110*a* according to an embodiment of the present invention.

Referring to FIG. 8, first through third power voltage wirings PW1-PW3 to which the first through third color power voltages ELVDD1-ELVDD3 generated by the power voltage generation unit 150 are respectively applied are arranged on the display panel 110*a*. The first through fourth power voltage lines PL1-PL4 are arranged on the display panel 110*a*. The first and fourth power voltage lines PL1 and PL4 are connected to the first power voltage wiring PW1. The second power voltage line PL2 is connected to the second power voltage wiring PW2. The third power voltage line PL3 is connected to the third power voltage wiring PW3. For example, the pixels PX in first and fourth columns connected to the first and fourth power voltage lines PL1 and PL4 may emit light of a first color. The pixels PX in a second column connected to the second power voltage line PL2 may emit light of a second color. The pixels PX in a third column connected to the third power voltage line PL3 may emit light of a third color.

A first through fourth dummy power voltage lines DPL1-DPL4 to which first through fourth dummy power voltages DVDD1-DVDD4 generated by the power voltage generation unit 150 are respectively applied are arranged on the display panel 110*a*. The present invention is not limited to the number of the dummy power voltage lines DPL. The number of the dummy power voltage lines DPL may be 4 or smaller or 5 or greater. The pixels PX may be repaired at least as many as the number of the dummy power voltage lines DPL. According to an embodiment, the dummy pixel DPX such as the dummy pixel DPX4 may repair a pixel PX41 to which a pixel power voltage PVDD41 is input with little voltage IR drop from the power voltage wiring PW. In this case, the dummy pixel DPX4 may be directly connected to the first power voltage wiring PW1.

According to another embodiment, when the pixel PX41 repaired by the dummy pixel DPX such as the dummy pixel DPX4 is adjacent, the dummy pixel DPX4 may be directly connected to the fourth power voltage line PL4 connected to the repaired pixel PX41.

The pixels PX are arranged on the display panel 110*a* in a matrix. A greater number of the pixels PX may be actually arranged on the display panel 110*a*. For example, a great number of the pixels PX may be present between the pixels PX in the second column and the pixels PX in the third column, and a great number of the pixels PX may be present between the pixels PX in the third column and the pixels PX in the fourth column.

Dummy pixels DPX1-DPX4 are arranged on the display panel 110*a*. Although one dummy pixel DPX corresponding to the pixels PX in a column is present, a plurality of the dummy pixels DPX corresponding to the pixels PX in a column may be present. Although the gate line GL and the source line SL are arranged on the display panel 110*a*, for better understanding of the drawings, the gate lines GL and the source lines SL are not illustrated.

Pixels PX11-PX19 in the first column are connected to the first power voltage line PL1. Current flows from up to down along the first power voltage line PL1, and thus a pixel power voltage PVDD11 input to the pixel PX11 may have the highest level, and a pixel power voltage PVDD19 input to the pixel PX19 may have the lowest level. The pixels PX11-PX19 in the first column are normal. The dummy pixel DPX1 is configured to be connectable to the first through third color power voltages ELVDD1-ELVDD3 and the first through fourth dummy power voltage lines DPL1-DPL4, whereas the dummy pixel DPX1 is not electrically connected thereto. The emission devices ED of the pixels PX11-PX19 in the first column and the dummy pixel DPX1 are not electrically connected to a first repair line RL1.

Pixels PX21-PX29 in the second column are connected to the second power voltage line PL2. The pixel PX24 among the pixels PX21-PX29 in the second column is assumed to be defective. The emission device ED of the pixels PX24 is electrically separated from the pixel circuit PC of the pixel PX24 and is connected to a second repair line RL2. A dummy pixel DPX2 is connected to the first dummy power voltage line DPI1 and the second repair line RL2. The first dummy power voltage DVDD1 having the substantially same level as that of a pixel power voltage PVD24 of the pixel PX24 is applied to the first dummy power voltage line DPL1.

As described above, the first dummy power voltage DVDD1 is generated by the power voltage generation unit 150 and has a time-variant level by the power voltage generation unit 150. The level of the first dummy power voltage DVDD1 may be determined based on at least a part (the image data RGB DATA corresponding to the pixels PX in the second column connected to the second power voltage line PL2) of the image data RGB DATA. For example, the control unit 140 may store information regarding a power voltage wiring network and information regarding a position of the repaired pixel PX24. The information regarding the power voltage wiring network may include information regarding a structure of the power voltage wiring network and a line resistance. The control unit 140 may store information regarding a size of current consumed when the pixels PX of first through third colors emit light. The control unit 140 may determine an amount of current flowing through the second power voltage line PL2 based on the image data RGB DATA corresponding to the pixels PX in the second column sharing the second power voltage line PL2 with the defective pixel PX24. The control unit 140 may determine a size of a voltage IR drop of the second power voltage line PL2 based on the amount of current. The control unit 140 may determine a level of a pixel power voltage PVDD24 based on the size of the voltage IR drop and control the power voltage generation unit 150 to generate the first dummy power voltage DVDD1 having the substantially same level as that of the pixel power voltage PVDD24. The image data RGB DATA may vary for each frame. The level of the first dummy power voltage DVDD1 may vary for each frame. As another example, the level of the first dummy power voltage DVDD1 may vary only when the at least a part of the image data RGB DATA greatly varies according to a preset algorithm.

A pixel PX38 is defective among the pixels PX in the third column and may be repaired by using a third dummy pixel DPX3. The emission device ED of the pixel PX38 is electrically separated from the pixel circuit PC of the pixel PX38 and is connected to a third repair line RL3. The dummy pixel DPX3 is connected to the second dummy power voltage line DPL2 and the third repair line RL3. A second dummy power voltage DVDD2 having the substantially same level as that of the pixel power voltage PVDD38 of the pixel PX38 is applied to the second dummy power voltage line DPL2.

The pixel PX41 is defective among the pixels PX in the fourth column and may be repaired by using a fourth dummy pixel DPX4. The emission device ED of the pixel PX41 is electrically separated from the pixel circuit PC of the pixel PX38 and is connected to a fourth repair line RL4. The dummy pixel DPX4 is connected to the first color power voltage ELVDD1 and the fourth repair line RL4. The first color power voltage ELVDD1 is supplied to the pixel PX41 without a substantial voltage IR drop, and thus a level of the pixel power voltage PVDD41 of the pixel PX41 is substantially the same as that of the first color power voltage ELVDD1. The first color power voltage ELVDD1 is applied to the dummy pixel DPX4 from the first power voltage wiring PW1, and thus the pixel PX41 may be repaired by using the fourth dummy pixel DPX4 to reduce image degradation. As another example, the dummy pixel DPX4 is connected to a third dummy power voltage line DPL3 and the fourth repair line RL4. A third dummy power voltage DVDD3 having the substantially same level as that of the pixel power voltage PVDD41 of the pixel PX41 is applied to the third dummy power voltage line DPL3.

Figure 9:
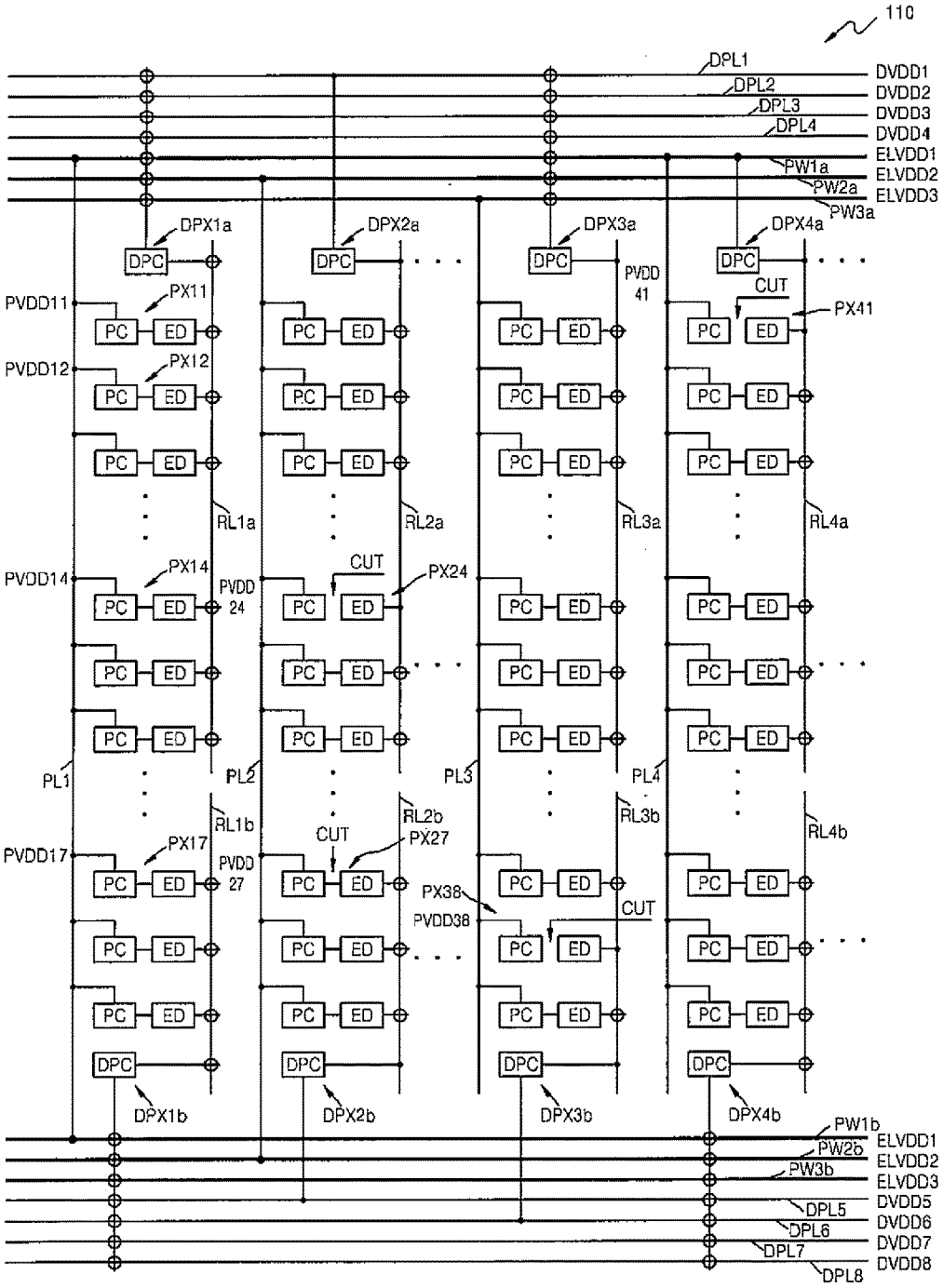
FIG. 9 is a schematic view of a display panel according to another embodiment of the present invention.

FIG. 9 is a schematic view of a display panel 110*b* according to another embodiment of the present invention.

Referring to FIG. 9, the display panel 110*b* is substantially the same as the display panel 110*a* of FIG. 8, except that the dummy pixels DPX, the color power voltage wiring PW, the dummy power voltage lines DPL are arranged on a lower portion of the pixels PX as well as an upper portion thereof, and each of the repair lines RL is divided into two parts in the display panel 110*b*. Descriptions of the redundant elements are omitted.

The pixels PX in a first column are normal. Pixels 24 and 27 are defective among the pixels PX in a second column. The pixel 24 may be repaired by using a dummy pixel DPX2*a* positioned in an upper portion of the pixels PX. The pixel 27 may be repaired by using a dummy pixel DPX2*b* positioned in a lower portion of the pixels PX.

A pixel 38 is defective among the pixels PX in a third column. The pixel 38 may be repaired by using a dummy pixel DPX3*b* positioned in a lower portion of the pixels PX. A dummy pixel DPX3*a* positioned in an upper portion of the pixels PX is not used to repair a defective pixel.

A pixel 41 is defective among the pixels PX in a fourth column. The pixel 41 may be repaired by using a dummy pixel DPX4*a* positioned in an upper portion of the pixels PX. A dummy pixel DPX4*b* positioned in a lower portion of the pixels PX is not used to repair a defective pixel.

The dummy pixels DPX, the color power voltage wiring PW, the dummy power voltage lines DPL are arranged on the upper and lower portions of the pixels PX on the display panel 110*b* of FIG. 9, thereby repairing the number of the pixels PX more than twice the display panel 110*a*. Furthermore, only one pixel may be repaired among the pixels PX in a column on the display panel 110*a*, whereas two pixels may be repaired among the pixels PX in a column on the display panel 110*b*.

As described above, according to the one or more of the above embodiments of the present invention, although a dummy pixel is used to repair a defective pixel, power voltages having the substantially same level are input to the repaired pixel and pixels around the repaired pixel. Thus, when the same image data is applied to the repaired pixel and the pixels around the repaired pixel, the repaired pixel and the pixels around the repaired pixel emit light having the same brightness. An organic light-emitting display apparatus according to the one or more of the above embodiments of the present invention may display an image with an improved quality.

It should be understood that the example embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims, and their equivalents.

What is claimed is:

1. An organic light-emitting display apparatus comprising:

a power voltage generation unit configured to generate a first power voltage and a dummy power voltage having a different level from that of the first power voltage;

a power voltage wiring network to which the first power voltage is applied;

a dummy power voltage line to which the dummy power voltage is applied;

a plurality of pixels each comprising an emission device and a pixel circuit electrically coupled to the power voltage wiring network;

a plurality of dummy pixels each comprising a dummy circuit being configured to be connectable to the dummy power voltage line; and a plurality of repair lines each being configured to be electrically connectable to the dummy circuit of a corresponding dummy pixel among the plurality of dummy pixels and to the emission devices of corresponding pixels among the plurality of pixels wherein, when the plurality of pixels comprise a first pixel comprising a defective pixel circuit, the emission device of the first pixel is electrically disconnected from the defective pixel circuit of the first pixel, and is electrically coupled to a corresponding first dummy pixel among the plurality of dummy pixels via a corresponding first repair line among the plurality of repair lines.

2. The organic light-emitting display apparatus of claim 1, wherein the power voltage generation unit is configured to generate the dummy power voltage having a time-variant level.

3. The organic light-emitting display apparatus of claim 1, further comprising: a control unit configured to receive image data and to control the plurality of pixels to display an image corresponding to the image data, wherein the control unit is configured to determine a level of the dummy power voltage based on at least a part of the image data, and to control the power voltage generation unit to generate the dummy power voltage having the determined level.

4. The organic light-emitting display apparatus of claim 3, wherein the control unit is configured to determine the level of the dummy power voltage for each frame, and wherein the level of the dummy power voltage varies for each frame.

5. The organic light-emitting display apparatus of claim 1, wherein the dummy circuit of the first dummy pixel is electrically coupled to the dummy power voltage line.

6. The organic light-emitting display apparatus of claim 5, wherein a first pixel power voltage having a lower level than that of the first power voltage is input to the defective pixel circuit of the first pixel due to a voltage IR drop of the power voltage wiring network, and wherein the power voltage generation unit is configured to generate the dummy power voltage of a same level as that of the first pixel power voltage, and to provide the dummy power voltage to the dummy circuit of the first dummy pixel.

7. The organic light-emitting display apparatus of claim 5, further comprising: a control unit configured to determine a level of the dummy power voltage and to control the power voltage generation unit to generate the dummy power voltage having the determined level.

8. The organic light-emitting display apparatus of claim 7, wherein the control unit is configured to determine the level of the dummy power voltage based at least partially on a position of the first pixel.

9. The organic light-emitting display apparatus of claim 7, wherein the power voltage wiring network comprises a power voltage wiring to which the first power voltage is applied, and a power voltage line for electrically coupling the power voltage wiring and the first pixel, wherein the plurality of pixels comprise second pixels electrically coupled to the power voltage line to which the second pixels and the first pixel are commonly coupled, and wherein the control unit is configured to determine the level of the dummy power voltage based on values of image data corresponding to the second pixels.

10. The organic light-emitting display apparatus of claim 9, wherein the lower the level of the dummy power voltage, the greater the values of the image data.

11. The organic light-emitting display apparatus of claim 9, wherein the control unit is configured to determine a size of a voltage IR drop between a first part of the power voltage line coupled to the power voltage wiring and a second part of the power voltage line coupled to the first pixel based on the values of the image data, and to determine the level of the dummy power voltage to be lower than a level of the first power voltage as much as the determined size of the voltage IR drop.

12. The organic light-emitting display apparatus of claim 1, wherein the dummy circuit is configured to be connectable to the power voltage wiring network.

13. The organic light-emitting display apparatus of claim 1, wherein a pixel power voltage having a lower level than that of the first power voltage due to a voltage IR drop of the power voltage wiring network is input to the pixel circuit, wherein the pixel circuit is configured to transfer the pixel power voltage to the emission device according to a logic level of a data signal input in a subfield unit, and wherein the emission device is coupled to the pixel circuit and is configured to emit light having a brightness corresponding to the pixel power voltage.

14. The organic light-emitting display apparatus of claim 13, wherein the pixel circuit comprises:

a first thin film transistor configured to be turned on according to a scan signal applied via a gate line and to transmit the data signal applied via a source line;

a second thin film transistor configured to be turned on according to the logic level of the data signal and to transfer the pixel power voltage to the emission device; and a first capacitor configured to maintain a turn-on status or a turn-off status of the second thin film transistor according to the logic level of the data signal.

15. An organic light-emitting display apparatus comprising:

a power voltage generation unit configured to generate a first power voltage and a plurality of first dummy power voltages;

a power voltage wiring network to which the first power voltage is applied;

a plurality of pixels each comprising an emission device and a pixel circuit coupled to the power voltage wiring network;

a plurality of first dummy power voltage lines to which the plurality of first dummy power voltages are applied; and a plurality of first dummy circuits wherein each of the first dummy circuits is configured to be connectable to the plurality of first dummy power voltage lines and wherein each of the first dummy circuits is configured to be connectable to the emission devices of corresponding pixels among the plurality of pixels, wherein, when the plurality of pixels comprise a first pixel comprising a defective pixel circuit, the emission device of the first pixel is electrically decoupled from the defective pixel circuit of the first pixel, and is electrically coupled to a corresponding first dummy circuit among the plurality of dummy circuits.

16. The organic light-emitting display apparatus of claim 15, further comprising:

a plurality of second dummy power voltage lines;

a plurality of second dummy circuits wherein each of the second dummy circuits is configured to be connectable to the plurality of second dummy power voltage lines and wherein each of the second dummy pixels is configured to be connectable to the emission devices of corresponding pixels among the plurality of pixels, wherein the power voltage generation unit is further configured to generate a plurality of second dummy power voltages respectively applied to the plurality of second dummy power voltage lines, and wherein the plurality of pixels are between the plurality of first dummy power voltage lines and the plurality of second dummy power voltage lines.

* * * * *